US005734327A

United States Patent [19]

Batterink et al.

[11] Patent Number: 5,734,327

[45] Date of Patent: Mar. 31, 1998

[54] DETECTION TAG

[75] Inventors: Henri Batterink, Aalden; Willem Angel, Zwolle, both of Netherlands

[73] Assignee: Dutch A & A Trading B.V., Harderwijk, Netherlands

[21] Appl. No.: 446,776

[22] PCT Filed: Nov. 12, 1993

[86] PCT No.: PCT/NL93/00239

§ 371 Date: Jul. 31, 1995

§ 102(e) Date: Jul. 31, 1995

[87] PCT Pub. No.: WO94/12957

PCT Pub. Date: Jun. 9, 1994

[30] Foreign Application Priority Data

Nov. 27, 1992 [NL] Netherlands ..... 9202067

[51] Int. Cl.[6] ..... G08B 13/14

[52] U.S. Cl. ..... 340/572; 340/551; 340/568; 340/505; 340/825.54

[58] Field of Search ..... 340/572, 551, 340/568, 825.54, 505

[56] References Cited

U.S. PATENT DOCUMENTS

| | | | |
|---|---|---|---|
| 4,021,705 | 5/1977 | Lichblau | 340/572 |
| 4,567,473 | 1/1986 | Lichtbiau | 340/572 |
| 4,728,938 | 3/1988 | Kaltner | 340/572 |
| 4,835,524 | 5/1989 | Camond | 340/572 |
| 4,876,555 | 10/1989 | Jorgensen | 340/572 |
| 4,906,974 | 3/1990 | Rehder | 340/572 |
| 4,970,495 | 11/1990 | Matsumoto | 340/568 |
| 5,103,210 | 4/1992 | Kode | 340/572 |

FOREIGN PATENT DOCUMENTS

| | | |
|---|---|---|
| 9109387 | 6/1991 | Switzerland . |

*Primary Examiner*—Jeffery Hofsass
*Assistant Examiner*—Albert K. Wong
*Attorney, Agent, or Firm*—Young & Thompson

[57] ABSTRACT

A detection tag for a resonance detection system. A resonance circuit is supported on an electrically insulative support, and includes and inductive track in a predefined pattern and a capacitive element with capacitor electrodes separated from each other by the support and connected to the respective ends of the inductive track. An electroconductive island is provided on the first side of the support with one of the capacitor electrodes, and is separated from that capacitor electrode by a discharge gap distance, and is also separated from the capacitor electrode on the other side of the support.

14 Claims, 2 Drawing Sheets

DETECTION TAG

BACKGROUND OF THE INVENTION

The invention relates to a detection tag for a resonance detection system, comprising a support consisting of electrically insulating material and a resonant circuit supported thereby, which has an inductive element formed by a conductor track disposed on the support in a predefined patter, and a capacitive element formed by at least two capacitor electrodes which are kept apart by the support and are constructed as electroconductive electrode regions, the ends of the track being connected to the one and to the other capacitor electrode, respectively.

A detection tag of this type is disclosed by the laid-open European Patent Application 0 463 233 A2.

The support of this known tag is provided on one side with a conductor track according to a spiral and rectangular pattern and on both sides is provided with electroconductive regions which form capacitor electrodes or plates of 4 capacitors. The capacitive element of the support is formed by a connection in parallel of 2 branches, in which two capacitors connected in series are incorporated. Said capacitive element is connected to the ends of the spiral track, as a result of which a resonant circuit is obtained having a resonant frequency which differs from a detection frequency which is used in an anti-theft system. The detection tag is activated by a capacitor being short-circuited in order to tune the resonant circuit to the detection frequency. If the activated detection tag has to be deactivated, a following capacitor is short-circuited, so that the resonant frequency of the tag once more differs from the detection frequency of the anti-theft system.

The capacitors to be short-circuited are provided with an indentation, as a result of which the corresponding plates are situated at a reduced mutual distance locally. The first capacitor is short-circuited by electromagnetic energy being supplied with a frequency which corresponds to the current resonant frequency of the tag and at a level which is sufficiently high to produce a discharge transversely to the support at the indentation of the capacitor in question. Short-circuiting of the second capacitor is effected in corresponding manner.

The known tag has the drawback that as a result of using indentations in the capacitors the resonant frequencies are not precisely defined, so that high energy levels or an additional tuning action are necessary.

SUMMARY OF THE INVENTION

The object of the invention is to provide a detection tag of the type mentioned in the preamble, which overcomes the abovementioned drawback.

This object is achieved according to the invention by at least one electroconductive island region being disposed on the support so as to be adjacent to, and in the same plane as, one of the capacitor electrodes, those edges of the island region and the capacitor electrode, which face one another, being situated at a discharge gap distance.

This arrangement has the advantage that, for the purpose of predefining a discharge path by means of the discharge gap, neither the quality factor nor the resonant frequency of the resonant circuit of the detection tag are adversely affected. Both variables remain precisely defined, even after the discharge, and indeed are not subject to scatter.

It should be noted that the European Patent Application 0 458 923 does disclose a discharge along the surface of the support, but this is used for short-circuiting a capacitor and not for increasing the capacitance of said capacitor. Moreover, an additional connection through the support is required.

Preferred embodiments are specified in the subordinate claims.

DESCRIPTION OF THE DRAWINGS

The invention will be described below in more detail with reference to the drawings, in which.

DESCRIPTION OF PREFERRED EMBODIMENTS

The detection tags shown in the figures can be used in an electronic detection system (not shown). It is generally known that a system of this type is used in shops to protect the articles present there against theft. An electronic protection system of this type is described, for example, in U.S. Pat. Nos. 4,692,744 and 4,831,363.

The known anti-theft system comprises a transmitter for emitting to, and generating electromagnetic fields in, a detection zone. Preferably a radio-frequency electromagnetic field having a predefined frequency, hereinafter called detection frequency. A frequency of 8.2 MHz is a suitable frequency, although other frequencies may also be used.

The electronic protection system further comprises a receiver for detecting the presence of a detection tag in the detection zone, by reason of this tag having a resonant frequency which is virtually identical to the detection frequency of the electromagnetic field. This tag is brought into resonance by the electromagnetic field, which is detected by the receiver.

The European Patent Application 0 463 233 describes an activable anti-theft tag which can be attached to an article to be protected. Said protection tag consists of a support made of electrically insulating material which supports a resonant circuit. The inductive portion of the resonant circuit is formed mainly by a conductor track disposed on the support in a spiral patter. The capacitive portion, supported by the support, of the resonant circuit is formed by a capacitor which in its initial state with the spirally wound coil has a first resonant frequency which differs from the detection frequency of the protection system. Said known detection tag is provided with means for altering the capacitance of the capacitor, in such a way that in the activated state the resonant frequency of the resonant circuit is equal to the detection frequency, while in the deactivated state the resonant frequency is again altered to a third frequency value. As long as the product has not been paid for at the till, the detection tag has a resonant frequency which is equal to the detection frequency of the security system, while after payment the tag is set to a deactivated state, in which the resonant frequency of the resonant circuit once more differs from the detection frequency of the security system, so that no theft detection will take place when the article with the detection tag is taken through the detection zone.

The known alteration of the capacitance value of the capacitive element of the resonant circuit is effected according to the European Patent Application in a known manner by means of a discharge transversely through the support, as a result of which a portion of the capacitive element is reduced in size each time.

Figure 1:
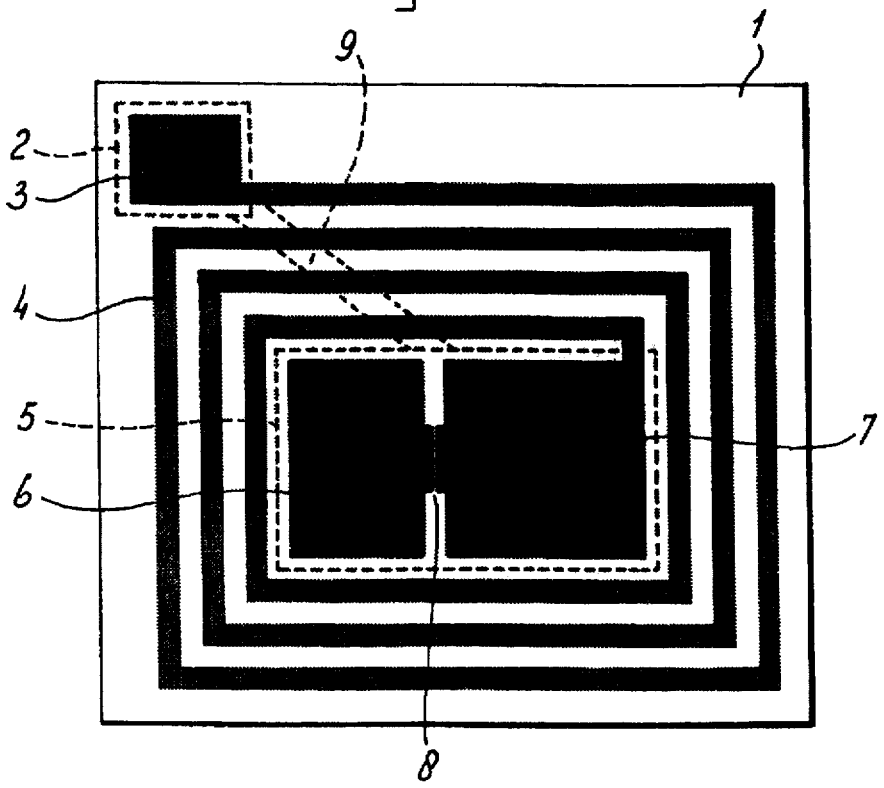
FIG. 1 shows an embodiment of the invention with two possible resonant frequencies.

FIG. 1 shows a detection tag according to the invention, in which the discharge takes place along the surface of the support.

This detection tag consists of a support 1, to which a conductor track 4 in the form of a spiral is applied. Said spiral-shaped track forms a coil having a predefined self-inductance. At one end, the track 4 is connected to a region 7 which is disposed on the same side of the support 1 and consists of electroconductive material. This region 7 forms one capacitor electrode of a capacitor, whose other capacitor electrode is formed by the region 5 which is disposed on the other side of the support 1 and consists of electroconductive material. This region 5 is connected by means of a track 9 to a connection region 2, likewise consisting of electroconductive material, which is connected through the support 1 to the connection region 3 of the track 4. Thus a resonant circuit is formed, in which the number of windings of the conductor track 4 and the area of the regions 5 and 7 are dimensioned in such a way that the resonant frequency of the resonant circuit is equal to the detection frequency of the electronic detection system to be used.

Adjacent to the region 7, there is disposed in the form of an island a region 6, likewise consisting of electroconductive material, on the same side of the support as the region 7.

Those edges of the regions 6 and 7, in which face one another, are at such a distance that a discharge is produced between the edges if the tag is subjected to an electromagnetic field whose frequency is equal to the resonant frequency or detection frequency which is determined by the self-inductance formed by the track 4 and the capacitance formed by the capacitor plates 5 and 7, and if the energy level of the electromagnetic field is sufficiently high to achieve this. This discharge gives rise to an electrical connection between the regions 7 and 6, so that the area of the capacitor electrode corresponding to the region 7 is increased by the area of the region 6. As a result, the detection tag is set to a resonant frequency which is reduced with respect to the detection frequency, so that the detection system will not react if this tag is moved into the detection zone.

As shown in FIG. 1, the electrode region 5 overlaps the island region 6. Depending on the area of the region 6 and the degree to which the region 5 overlaps the region 6, an enlargement of the capacitor and, consequently, a corresponding reduction of the resonant frequency is achieved.

The support 1 may, for example, consist of a flexible plastic film having a thickness of 20 μm, such as, for example, polyethylene. This flexible support has the track 4 and the conductive regions 2, 3, 5, 6 and 7 disposed thereon by means of, for example, a deposition or etching process. The conductive material may consist of aluminium with a thickness of, for example, from 15 to 50 μm.

According to FIG. 1, a well-defined discharge gap 8 is formed as a result of the distance between the edges facing each other of the regions 6 and 7 being reduced locally to, for example, less than 5 μm. Experiments have shown that a voltage of from 80 to 90 volts between the gap edges is sufficient to produce a discharge.

The detection tag according to the invention has the advantage that the quality factor of the resonant circuit is not affected by the addition of the discharge gap, and this factor is accurately defined even after the discharge process. Moreover, the resonant frequencies can be set rapidly and easily during fabrication, for example by means of a laser beam, while remaining well-defined, since the discharge will not affect them. This provides for more accurate detection than in the known detection tags.

Owing to the fact that the resonant frequencies can be defined more accurately and the quality factor and the resonant frequency remain well-defined at all times, the detection tag can easily be extended to a plurality of resonant frequencies. A preferred embodiment is shown in FIG. 3.

Figure 3:
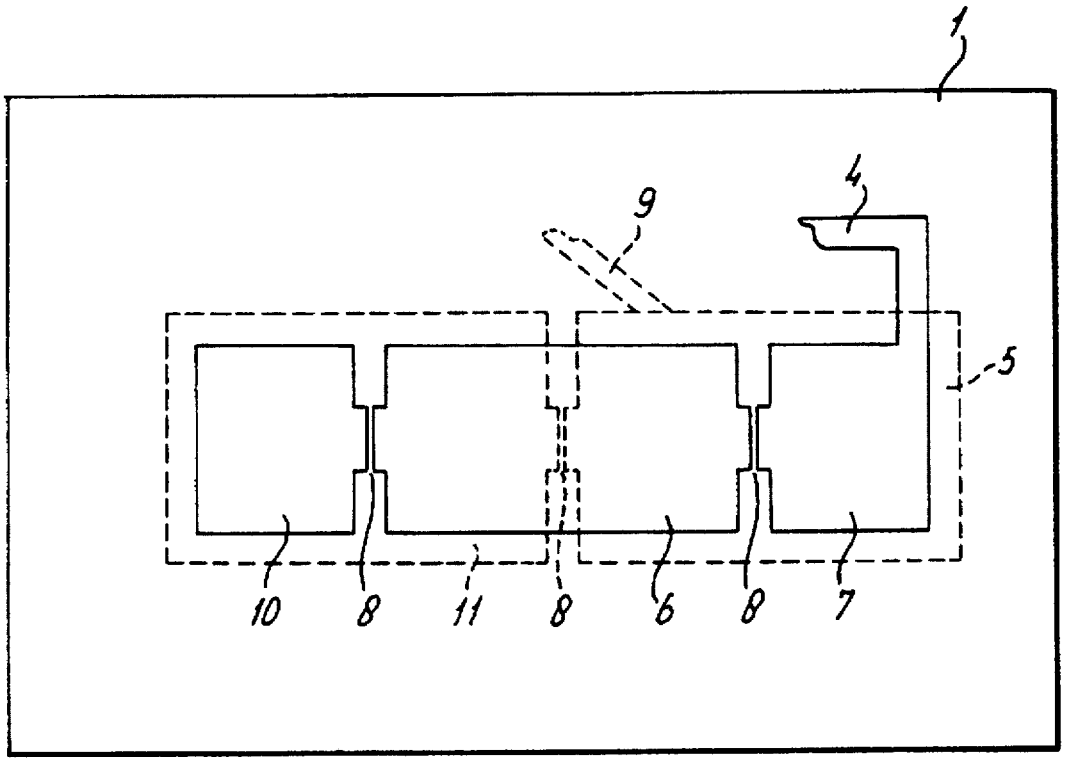
FIG. 3 depicts a further embodiment of the invention with four possible resonant frequencies.

The embodiment shown in FIG. 3 provides the possibility of four resonant frequencies. For the sake of clarity, the inductive component of the resonant circuit is not shown.

The capacitor supported by the support 1 consists of the capacitor electrode 7 which by means of the connection 4 is connected to one end of the inductive component (not shown). Disposed on the other side of the support 1, there is the other capacitor electrode 5 which by means of the connection 9 is connected to the other end of the inductive component (not shown) of the resonant circuit of the tag. In addition to the island region 6 there is disposed, adjacent thereto, another island region 10 on the same side of the support 1. On the other side of the support 1, a further island region 11 is applied. Between the regions 7 and 6, 6 and 10 and 5 and 10, respectively, discharge gaps 8 are present.

The resonant frequency, which is determined by the capacitance between the regions 5 and 7 on the one hand, and the inductive component (not shown) is, for example 8.2 MHz. If the detection tag is subjected to an electromagnetic field having a frequency of 8.2 MHz and a sufficiently high energy level, a discharge is produced between the discharge gap 8 between the regions 6 and 7, as a result of which the resonant frequency of the resonant circuit of the detection tag is lowered to, for example, 6.2 MHz. Said resonant frequency obviously depends on the dimensions of the regions 6 and 7 and the self-inductance of the inductive component of the detection tag. In a similar manner, a discharge can be brought about successively between the remaining discharge gaps 8, as a result of which resonant frequencies of, for example, 5 and 4 MHz, respectively, can be achieved.

The number of resonant frequencies can be increased to a virtually unlimited extent. For example, the first resonant frequency can be added to the initial rest state of the detection tag, while a second frequency can be added to the activated state of the detection tag. Said second resonant frequency is then used for detecting a theft. The other resonant frequencies can then be used for coding miscellaneous information such as, for example, the number of articles bought, and other information. It is evident that the detection system must be extended in accordance with the number of possible resonant frequencies of the detection tag.

In order to code an item of information on the detection tag, an electromagnetic field is preferably used having a frequency swing which is set to obtain a preselected resonant frequency.

In a preferred embodiment of the detection tag, the conductor track is disposed spirally around the area occupied by the capacitor regions and conductive regions. The advantage of this is that no additional connections are required between the regions on the one hand and the spiral track.

Figure 2:
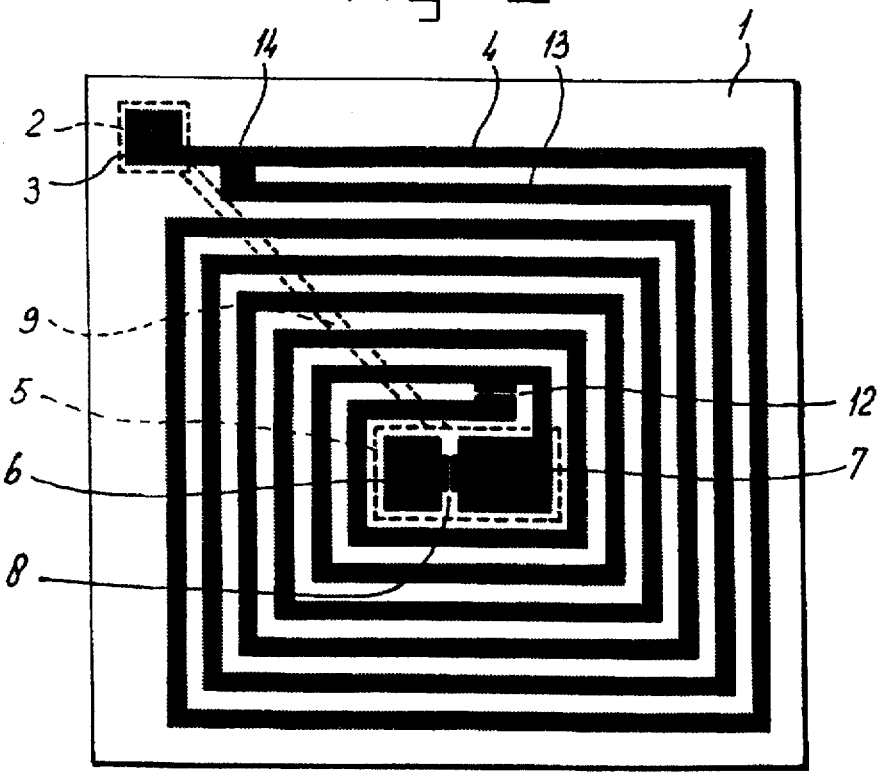
FIG. 2 illustrates another embodiment of the invention with two possible resonant frequencies.

FIG. 2 shows another embodiment of the invention, in which it is possible, by means of an electromagnetic island region, to increase the initial resonant frequency. This detection tag consists of a support 1, on which a spiral track 4 is disposed which, by means of the connection regions 3 and 2, the through-connection effected between said two regions through the support 1, and the connection 9, is connected to the capacitor electrode 5 on the other side of the support 1. The other capacitor electrode 7 is connected to the other end of the spiral track 4. This configuration defines a first resonant frequency. A second, higher resonant frequency is obtained by an island region 13 in the shape of a spiral which is disposed within the spiral 4. The spiral 13 is connected to the spiral 4 by means of the connection 14, while the other end of the spiral 13 is disposed at a small distance 12 from the opposite end of the spiral 4. The distance 12 defines a discharge gap. If the detection tag is subjected to an electromagnetic field having a frequency which is equal to the initial resonant frequency of the tag, a discharge between the discharge gap 12 is brought about, as a result of which the self-inductance of the resonant circuit is increased, and a second, high resonant frequency is obtained. A lowering of the resonant frequency can be achieved once more by a discharge between the discharge gap 8 which is situated between the regions 6 and 7.

The track 4 may also run within track 13, but it is also possible to add more tracks with discharge gaps which correspond to the track 13.

Figure 4:
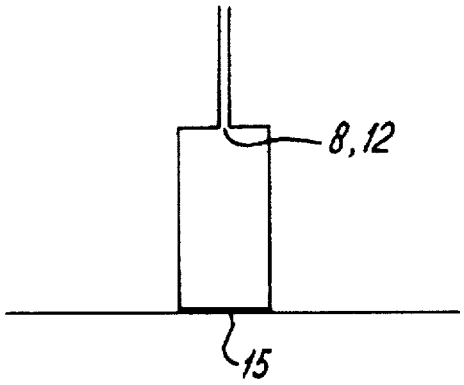
FIG. 4 shows yet another embodiment of the invention.

In the embodiment shown in FIG. 4, the discharge gap 8, 12 is bridged by a resistor in the form of a resistor track 15. If no discharge has taken place so far and the resistor, for example, bridges a gap between two adjacent capacitor electrode regions, the circuit consists of a parallel connection of an inductor and a parallel subconnection of a first capacitor and a series-connection of a second capacitor and a resistor. As a result, the resonant frequency is shifted somewhat compared to a configuration without a resistor, while the quality factor of the circuit is somewhat reduced, depending on the resistance which may, for example be 1 kΩ or higher. After a discharge across the gap has been carried out, the resistor is short-circuited, while the quality factor of the circuit has increased again.

The same effects occur if the bridging resistor is connected in parallel with the inductors (see FIG 2: 12). It was therefore found that the discharge causes both a well-defined frequency change and a quality change of the circuit. As a result, an amplitude and a decay behaviour are observed which depend on whether or not a discharge has been carried out. This embodiment has the advantage that detection can take place based on amplitude, frequency, phase and/or decay time.

Moreover, the invention has the advantage that prior to or following a discharge, it is possible to test whether the circuit has been damaged.

In general, the invention has the advantage that after each discharge a residual resonance remains present at all times, so that it is possible to detect whether or not the circuit has been damaged. Application of the invention further makes available a detection tag which can be reused after activation by discharge. After all, the through-connection between adjacent regions, caused by the discharge, can be removed again by supplying energy at a high level. The original state with a discharge gap is thus obtained.

It is evident that the detection tag according to the invention is suitable not only for detecting theft, but also for detecting other information.

We claim:

1. A detection tag for a resonance detection system, comprising a support consisting of electrically insulating material and a resonant circuit supported thereby, which has an inductive element formed by a conductor track disposed on the support in a predefined pattern, and a capacitive element formed by at least two capacitor electrodes which are kept apart by the support and are constructed as electroconductive electrode regions, the ends of the track being connected to the one and to the other capacitor electrode, respectively, wherein at least one island region (13) is disposed on a first side of the support (1) so as to be adjacent to, and in the same plane as, the conductor track (4) and so as to be separated from a second side of the support, in that one end of the island region is connected to one end of the track, and in that there is present, between the edges thereof facing each other, a discharge gap (12).

2. The detection tag according to claim 1, wherein the conductor track (4) and the island region (13) have a spiral shape and run between one another.

3. The detection tag according to claim 1, wherein at least one discharge gap is bridged by a resistor.

4. The detection tag according to claim 1, wherein the tag is subjected to an electromagnetic field having a frequency swing which is set so as to obtain at least one preselected resonant frequency on the support.

5. The detection tag according to claim 1, wherein at least one discharge gap is bridged by a resistor.

6. The detection tag according to claim 1, wherein the tag is subjected to an electromagnetic field having a frequency swing which is set so as to obtain at least one preselected resonant frequency on the support.

7. A detection tag for a resonance detection system, comprising:

an electrically insulative support;

a resonance circuit supported by said support, said resonance circuit comprising an inductive track in a predefined pattern, a capacitive element with capacitor electrodes separated from each other by said support and connected to respective ends of said inductive track; and first electroconductive island on a first side of said support with a first one of said capacitor electrodes, said first island being separated from said first capacitor electrode by a discharge gap distance and separated from a second said capacitor electrode on a second side of said support by said support.

8. The tag of claim 7, wherein said first island overlaps at least a portion of said second capacitor electrode, whereby an increase in the overlap increase the capacitance of said resonance circuit.

9. The tag of claim 7, further comprising at least a second said electroconductive island on said first side of said support and which is separated from said first island by a further discharge gap distance.

10. The tag of claim 9, further comprising at least a third said electroconductive island on said second side of said support and which is separated from said second capacitor electrode by a discharge gap distance and separated from said first island by said support.

11. The tag of claim 7, further comprising a constriction between said first island and said first capacitor electrode, said constriction defining the discharge gap distance.

12. The tag of claim 7, further comprising at least a second said electroconductive island on said second side of said support which is separated from said second capacitor electrode by a discharge gap distance and separated from said first island by said support.

13. The tag of claim 7, wherein a portion of said track on said first side spirals around said first capacitor electrode and said first island.

14. The tag of claim 13, wherein a portion of said track external to said spiral portion extends through said support to said second side.

* * * * *